US007439679B2

(12) United States Patent
Grivas et al.

(10) Patent No.: US 7,439,679 B2
(45) Date of Patent: Oct. 21, 2008

(54) METHOD AND APPARATUS FOR ILLUMINATING LIGHT SOURCES WITHIN AN ELECTRONIC DEVICE

(75) Inventors: Chris J. Grivas, Crystal Lake, IL (US); Erik A. Cholewin, Libertyville, IL (US); Andrew S. Lundholm, Hoffman Estates, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/377,802

(22) Filed: Mar. 16, 2006

(65) Prior Publication Data

US 2007/0216320 A1 Sep. 20, 2007

(51) Int. Cl.
*H05B 37/02* (2006.01)
*G09G 37/00* (2006.01)

(52) U.S. Cl. ..... 315/169.3; 315/291

(58) Field of Classification Search ..... 315/244, 315/291, 307, 169.3, 169.4; 345/102, 156, 345/172, 204, 211–212, 213–214
See application file for complete search history.

(56) References Cited

U.S. PATENT DOCUMENTS

| | | | | |
|---|---|---|---|---|
| 5,970,419 | A | 10/1999 | Terashima et al. | |
| 6,119,023 | A * | 9/2000 | Tomiyori | 455/574 |
| 6,404,145 | B1 * | 6/2002 | Saito | 315/307 |
| 6,798,395 | B1 * | 9/2004 | Yamauchi et al. | 345/102 |
| 6,873,203 | B1 | 3/2005 | Latham et al. | |
| 7,076,234 | B2 * | 7/2006 | Grivas et al. | 455/343.1 |
| 2002/0048169 | A1 * | 4/2002 | Dowling et al. | 362/234 |
| 2005/0057539 | A1 | 3/2005 | Ong | |
| 2005/0122060 | A1 | 6/2005 | Yu et al. | |
| 2005/0218838 | A1 * | 10/2005 | Lys | 315/291 |
| 2005/0231633 | A1 * | 10/2005 | Yuyama et al. | 348/370 |
| 2005/0253799 | A1 * | 11/2005 | Kamio | 345/103 |

* cited by examiner

*Primary Examiner*—Douglas W. Owens
*Assistant Examiner*—Minh Dieu A
(74) *Attorney, Agent, or Firm*—Philip H. Burrus, IV

(57) ABSTRACT

A method and apparatus for controlling a plurality of light sources (102,103,104,105) in an electronic device (100) is provided. In one embodiment, the plurality of light sources (102,103,104,105) is used to backlight an illuminated display (101). As switching multiple light sources on simultaneously can cause output voltages of power sources (219) to drop, thereby potentially affecting the overall operation of the electronic device (100), an illumination controller (107) distributes actuation times associated with illumination control signals (204,205,206,207) such that each actuation time is unique. A control signal generator (201) produces a control signal (202) having light source actuation information stored therein. The illumination controller (107) then generates a plurality of illumination control signals (204,205,206,207) that are capable of actuating the plurality of light sources (102,103,104,105). Each illumination control signal (204, 205,206,207) has a duty cycle and actuation time associated therewith. The illumination controller (107) distributes the actuation times across the control signal (202) so as to reduce the instantaneous current drawn by the plurality of light sources (102,103,104,105).

20 Claims, 5 Drawing Sheets

METHOD AND APPARATUS FOR ILLUMINATING LIGHT SOURCES WITHIN AN ELECTRONIC DEVICE

BACKGROUND

1. Technical Field

This invention relates generally to a method and apparatus for actuating light sources, for example light emitting diodes, and more specifically to a method and apparatus for actuating a light source for illuminating a display or annunciator on an electronic device by staggering a plurality of pulse width modulated signals.

2. Background Art

Many electronic devices, including mobile telephones, personal digital assistants, and portable computers, include displays by which information is presented to a user. Many of these displays include lighting so that the display may be easily viewed in a dark environment. Some displays, like liquid crystal displays for instance, require the use of lighting for their operation regardless of the environment. Transmissive type liquid crystal displays include a variable translucent pixilated display and a backlight, such as a fluorescent lamp, light emitting diode, or other similar device, that projects light from behind the display. By selecting which pixels pass light and which do not, images are created on the display.

In many devices, multiple light sources may be used for backlighting. While some liquid crystal display televisions may employ a single bulb, smaller portable devices often use several light emitting diodes to illuminate their displays. One prior art method of illuminating the display is to turn on all of the light sources when the display is active, allowing them to remain on so long as information is active on the display. For example, where a person opens a flip-style telephone, the light sources may all come on and remain on until the telephone is closed.

The problem with this prior art solution is due to the fact that light sources consume power. Where the device is a battery-powered device, like a mobile telephone for example, energy consumed by light sources cannot be used in making telephone calls. The result is a shorter run time between battery recharges.

One prior art solution to this reduced run time problem is to pulse the light sources on and off while the display is active. As the human eye integrates rapidly passing images, rather than turning all the light sources on and leaving them on, the device may rapidly pulse the light sources on and off, on and off, and so forth. The net result is a display that looks illuminated to the human eye, but consumes less power than a continuously illuminated one.

The problem with this prior art solution is that turning multiple light sources on and off rapidly causes large current pulses to be drawn from the power supply. Where the power supply has an inherent, internal impedance, as is the case with a rechargeable battery, large instantaneous currents may cause the output voltage of the power source to fall. Thus, by actuating several light sources simultaneously, the supply voltage may dip or become erratic. Where the dips become significant, other operations within the device may be compromised. For example, dips in the supply voltage may cause undesirable flickering in the light sources themselves. Additionally, audio buzz, digital camera noise, communication problems, and other problems may be caused.

There is thus a need for an improved method and apparatus for illuminating displays and other devices within portable electronics.

Figure 1:
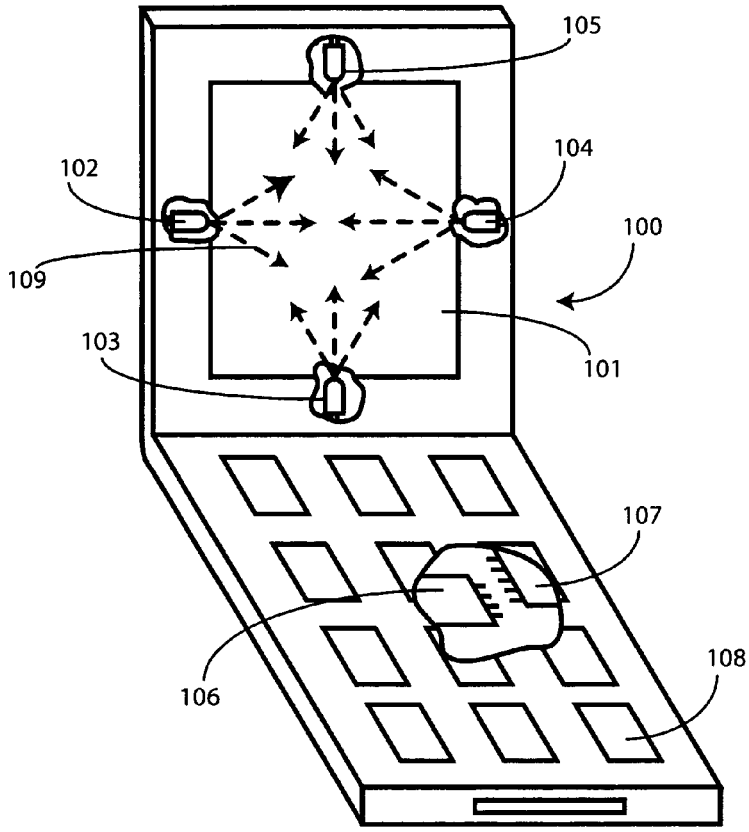
FIG. 1 illustrates an electronic device in accordance with the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Before describing in detail embodiments that are in accordance with the present invention, it should be observed that the embodiments reside primarily in combinations of method steps and apparatus components related to a method and apparatus for illuminating displays and annunciators within electronic devices. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

It will be appreciated that embodiments of the invention described herein may be comprised of one or more conventional processors and unique stored program instructions that control the one or more processors to implement, in conjunction with certain non-processor circuits, some, most, or all of the functions of illuminating a plurality of light sources as described herein. The non-processor circuits may include, but are not limited to, a radio receiver, a radio transmitter, signal drivers, clock circuits, power source circuits, and user input devices. As such, these functions may be interpreted as steps of a method to perform illuminating light sources in accordance with the invention. Alternatively, some or all functions could be implemented by a state machine that has no stored program instructions, or in one or more application specific integrated circuits (ASICs), in which each function or some combinations of certain of the functions are implemented as custom logic. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." In this document, relational terms such as first and second, top and bottom, and the like may be used solely to distinguish one entity or action from another entity or action without necessarily requiring or implying any actual such relationship or order between such entities or actions. Reference designators in parentheses refer to elements of the drawings found in a drawing not then under discussion. For example, a reference to component A (110) while discussing FIG. 2 indicates that component A appears in a figure other than FIG. 2.

In one embodiment of the present invention, a method and apparatus for illuminating light sources includes staggering the actuation times of a plurality of pulse-width modulated signals such that the actuation times of the various signals are different. This staggering reduces the instantaneous current drawn from the power supply at any one moment, thereby reducing the variability of the power supply output voltage. Although the average current drawn by the current sources may still be the same, the peak current drawn at any one instant decreases when compared to prior art solutions.

The more uniform current drain offered by the present invention is particularly suitable to battery-powered devices. The method and apparatus described herein works to reduce the instantaneous current burden on the battery (by eliminating the need for the battery to supply large peak currents). Additionally, components associated with hardware power management circuitry, including capacitors and inductors, may be reduced in size, thereby reducing the overall cost of the device. Enhanced reliability also results, as components and devices in accordance with the invention exhibit increased mean time between failures at lower current levels.

The method and apparatus of the invention are suitable for various types of light sources. For instance, some devices may employ the invention for use with light emitting diodes in portable electronic devices, while others may employ the invention with larger devices having incandescent bulbs or electroluminescent panels. It is, of course, possible to mix combinations of these lighting technologies, and others, while remaining within the spirit and scope of the invention.

Turning now to FIG. 1, illustrated therein is one embodiment of portable electronic device 100 in accordance with the invention. While shown for illustrative purposes as a wireless communication device 100, it will be clear to those of ordinary skill in the art having the benefit of this disclosure that the invention is not so limited. Other devices, including portable computers, personal digital assistants, pagers, two-way radios, televisions, MP3 players, DVD players, and the like could also use the invention. In one embodiment well suited for the invention, the wireless communication device 100 is a mobile telephone.

The wireless communication device 100 includes an illuminated display 101 for presenting information to a user. The illuminated display 101, which may be a backlit, user readable display, is illuminated by a plurality of light sources 102,103,104,105. The plurality of light sources 102,103,104,105, in one embodiment, comprise a plurality of light emitting diodes, although other light sources, including electroluminescent panels and other equivalents, may be substituted. When the plurality of light sources 102,103,104,105 are active, they project light across or through the illuminated display 101 so as to achieve an average luminous intensity 109 that is perceivable by a user.

The illuminated display 101 includes a user interface 108 for receiving an input from a user. The user interface 108 may be a keypad, as illustrated in FIG. 1. Alternatively, the user interface 108 may be a touch-sensitive display or voice activated module. As will be seen in the discussion below, a user may supply illumination information to the device for altering the actuation times or durations for the plurality of light sources 102,103,104,105 by way of the user interface 108.

The wireless communication device 100 includes internal circuitry responsible for the operation of the device 100. The internal circuitry may include a microprocessor 106 and associated memory for performing basic functions. Firmware code, disposed within the memory, may include instructions for operating programs, applications and operating systems. An illumination controller 107 is coupled to the microprocessor 106. The illumination controller 107 works in conjunction with the microprocessor 106 to properly control the light sources 102,103,104,105.

Figure 2:
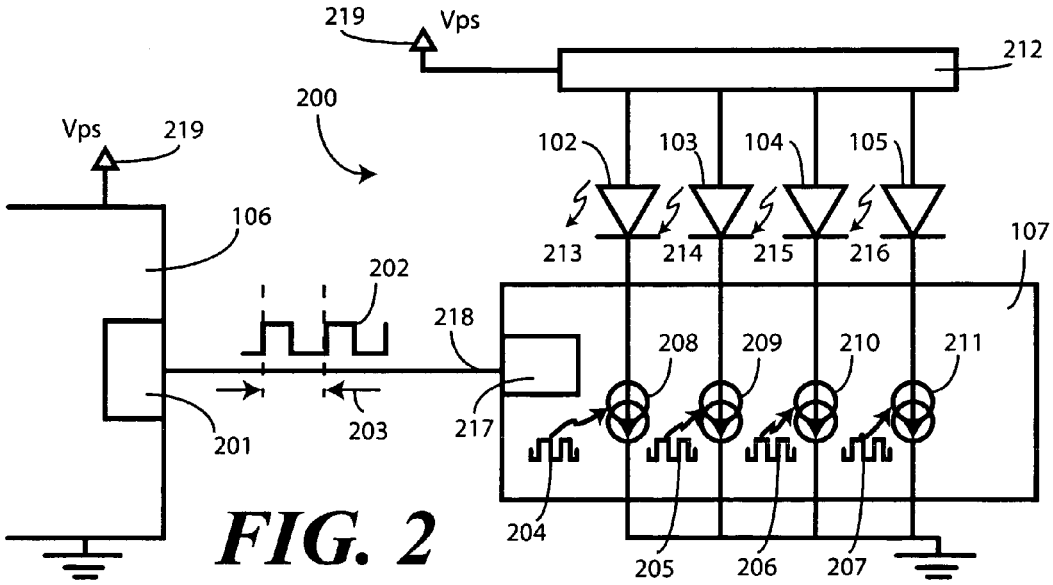
FIG. 2 illustrates an illumination controller and associated circuitry in accordance with the invention.

Turning now to FIG. 2, illustrated therein is a block diagram view of a subset of the internal circuitry of the illuminated display (101). Here, the microprocessor 106, the illumination controller 107, and the plurality of light sources 102,103,104,105 may be seen. The circuitry of FIG. 2 may be provided in the form of a drop-in module 200 suitable for use in various electronic devices. For example the illumination controller 107, microprocessor 106, or both may be disposed within an application specific integrated circuit for use with other electronic components in other applications.

In one embodiment the microcontroller 106 includes a control signal generator 201 capable of generating at least control signal 202. While the control signal generator 201 may be either an independent IC or embedded with other components, the illumination controller 107 uses this pulse-width modulated signal 202 to actuate the plurality of light sources 102,103,104,105 in accordance with the light source actuation information found within the control signal 202.

The control signal 202 includes light source actuation information stored therein. In one embodiment, this light source actuation information is contained within the pulse-width modulated waveform itself. While a pulse-width modulated control signal is one exemplary embodiment described herein, other forms of control signals may also be employed. For example, the control signal 202 may comprise a digital signal, i.e. a serial or parallel communication of digital bits, bytes or words, that direct the illumination controller. Alternatively, the control signal 202 may be a simple analog signal, where the level of the analog signal is indicative of the illumination information. Optical signals, RF signals, and other communication mechanisms may be used to convey the control signal 202 from the control signal generator 201 to the illumination controller 107.

Where a pulse-width modulated signal is used as the control signal 202, the period and predetermined duty cycle of the control signal 202 may be indicative of the amount of time in which each of the plurality of light sources 102,103,104,105 should be activated. For example the duty cycle, represented as element 203 in FIG. 2, is defined by the amount of time the control signal 202 is active divided by the amount of time the control signal 202 is inactive. As such, the light source actuation information may be indicated by a predetermined duty cycle 203 defined by a proportion of active signal time. In such an embodiment, when the predetermined duty cycle 203 is active, each of the plurality of light sources 102,103,104,105 may be active for the same amount of time, a proportional amount of time, longer amount of time, or a lesser amount of time.

The illumination controller 107, coupled between the control signal generator 201 and the plurality of light sources 102,103,104,105, receives the control signal 202 having the illumination information stored therein by way of an input 218. Upon receipt of the control signal 202, the illumination controller 107 generates a plurality of illumination control signals 204,205,206,207 that may be used to actuate the plurality of light sources 102,103,104,105. Each illumination control signal 204,205,206,207, as will be described in more detail in the discussion of FIGS. 3-8, has an illumination control duty cycle associated therewith.

The illumination control duty cycle includes an active portion, an inactive portion and an actuation time. The actuation time is the switching time between the inactive portion and the next active portion. In one embodiment, the illumination controller 107 generates the plurality of illumination control signals 204,205,206,207 such that each of the actuation times is unique, such that each of the plurality of light sources 102,103,104,105 becomes operable at uniquely different times.

The unique actuation times may be obtained by way of a distributor 217. In one embodiment, the distributor 217 is included to stagger each actuation transition from an inactive portion of the illumination control signal to an active portion of the illumination control signal. The staggering of the actuation times causes each actuation transition to occur at a different time, thereby reducing the instantaneous current drawn from a power source 219. In one embodiment, the distributor 217 distributes the actuation transitions evenly across a period of the control signal 202.

In one embodiment, the illumination controller 107 includes a plurality of current sources 208,209,210,211 coupled to the plurality of light sources 102,103,104,105. Each of the plurality of current sources 208,209,210,211 is coupled serially between each of the plurality of light sources 102,103,104,105 by way if a plurality of outputs 213,214,215,216. Note that while in the exemplary embodiment of FIG. 2 the plurality of current sources 208,209,210,211 are coupled to the cathodes of the plurality of light sources 102,103,104,105, as they are serial elements they may likewise be coupled to the anodes. Through the actuation of plurality of current sources 208,209,210,211, the plurality of light sources 102,103,104,105 may be turned on and off. Note that as the plurality of current sources 208,209,210,211 may be configured as combinations of transistors, where the illumination controller 107 is configured as a stand-alone module, the plurality of outputs 213,214,215,216 may be capable of generating the plurality of illumination control signals 204,205,206,207. Thus, each output 213,214,215,216 of the module would be capable of actuating the plurality of light sources 102,103,104,105.

As shown in FIG. 2, when a particular current source is active, current is drawn through the corresponding light source, thereby causing it to illuminate. Thus, by controlling the plurality of current sources 208,209,210,211, the illumination controller 107 is capable of controlling the corresponding plurality of light sources 102,103,104,105. By driving the plurality of current sources 208,209,210,211 with the plurality of illumination control signals 204,205,206,207, each current source 208,209,210,211 may be active when the corresponding illumination duty cycle is active.

A power source 219 is coupled to the plurality of light sources 102,103,104,105. In some embodiments, a regulator 212 may be coupled serially between the power source 219 and the plurality of light sources 102,103,104,105. For example, to potentially increase the brightness of the plurality of light sources 102,103,104,105, a boost regulator may be used, and may be coupled between the power source 219 and the plurality of light sources 102,103,104,105. Other applications may dictate the use of other power regulation systems, including buck regulators, linear regulators and so forth. Where the regulator 212 is employed, when the current sources 208,209,210,211 are actuated, each of the plurality of light sources 102,103,104,105 conducts current from the regulator 212. Where no regulator 212 is employed, actuation of the current sources 208,209,210,211 causes current to be drawn directly from the power source 219. By staggering the actuation times, the illumination controller 107 is able to reduce the instantaneous current drawn from, and thus the output voltage ripple of, the power source 219, regulator 212, or both.

In one embodiment, it is desirable to have only one light source on at a time, thereby minimizing the amount of instantaneous current drawn by the plurality of light sources 102,103,104,105. As such, the illumination controller 107 may distribute the actuation times such that one light source comes on just as another light source goes off. In so doing, only one light source is active at a time, thereby helping to minimize the current drain from the power source 219.

Turning now to FIGS. 3-8, illustrated therein are exemplary waveforms for the control signal (202) and the illumination control signals (204,205,206,207) from FIG. 2. The waveforms in FIGS. 3-8 are intended to be an illustrative survey of some of the waveforms and actuation times that may be gleaned from various illumination control signals (204,205,206,207) generated by the illumination controller (107). The illustrative examples are not intended to be comprehensive. It will be clear to those of ordinary skill in the art having the benefit of this disclosure that other waveform combinations may be obtained while remaining within the scope of the invention. For discussion purposes, the control signals are referenced as element 202 and a differentiating letter, while the illumination control signals will be referred to as elements 204,205,206,207 and a differentiating letter.

Figure 3:
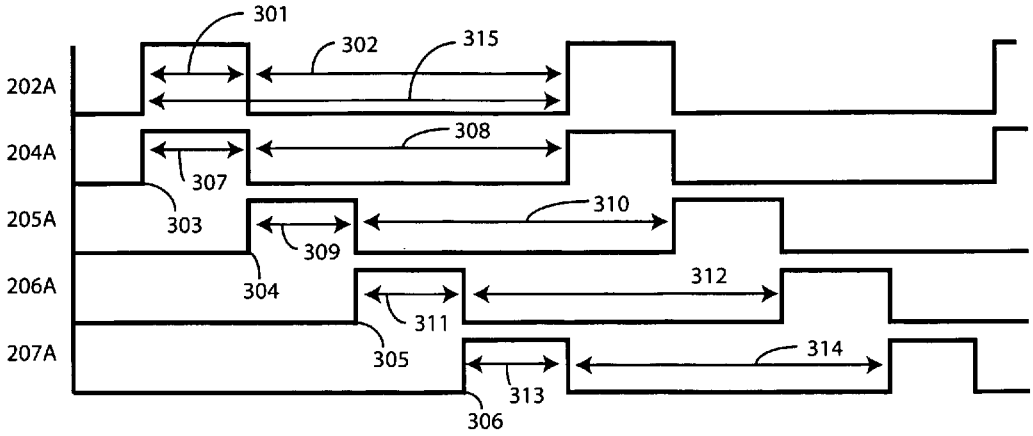
FIGS. 3,4,5 illustrate timing diagrams where an active portion of an illumination control signal is less than an active portion of a control signal in accordance with the invention.

Turning first to FIG. 3, illustrated therein is an exemplary control signal 202A and illumination control signals 204A, 205A,206A,207A that may be generated by an illumination controller (107) in accordance with the invention upon receipt of control signal 202A. As noted above, the control signal 202A includes light source actuation information, which may take the form of the active portion 301 of the control signal 202A. The light source actuation information may represent the periodic amount of time for which the plurality of light sources (102,103,104,105) is to be illuminated, as is the case in FIGS. 3-5. Alternatively, the light source actuation information may merely be indicative of the periodic amount of time for which the plurality of light sources (102,103,104,105) are to be illuminated, as is the case in FIGS. 6-8.

In FIG. 3, the proportion of active signal time, represented as "301/302", since the proportion is time 301 "divided by" time 302, corresponds to the periodic amount of time for which the plurality of light sources (102,103,104,105) are to be illuminated to achieve a predetermined average luminous intensity. In the exemplary embodiment of FIG. 3, the illumination control duty cycle, e.g. 307/308 of signal 204A, is substantially equal to the predetermined duty cycle 301/302 of control signal 202A.

The duty cycles of the other illumination control signals, i.e. duty cycle 309/310 of illumination control signal 205A, the duty cycle 311/312 of illumination control signal 206A, and the duty cycle 313/314 of illumination control duty cycle 206A, are substantially the same as that of control signal 202A. Note, however, that the actuation times 303,304,305, 306 are distributed across the period 315 of the control signal 202A such that each actuation time 303,304,305,306 of each illumination control signal 204A,205A,206A,207A is different. This staggering of actuation times reduces the instantaneous current drawn from the power source (219).

In the illustrative example of FIG. 3, the actuation times 303,304,305,306 have been distributed across the period 315 of the control signal 202A evenly. In such an exemplary embodiment, where the control signal 202A is a pulse-width modulated signal having a predetermined period 319, the active portion 301 of the signal 202A may represent a period of time during which each individual light source (102,103, 104,105) is to be active. As such, the illumination control signals 204A,205A,206A,207A have been distributed proportionally across the predetermined period 315 of the control signal 202A so as to maximize the on-time of each light source.

Also, the actuation times 303,304,305,306 have been distributed such that only one light source (102,103,104,105) is active at a time. This is done by having each actuation time occur when the preceding light source goes off. In other words, actuation time 304 occurs when illumination control signal 204A transitions from its active state 307 to its inactive state 308, and so forth. Such a "one light at a time" scenario helps to reduce and minimize instantaneous currents being drawn through the plurality of light sources (102,103,104, 105).

Figure 4:
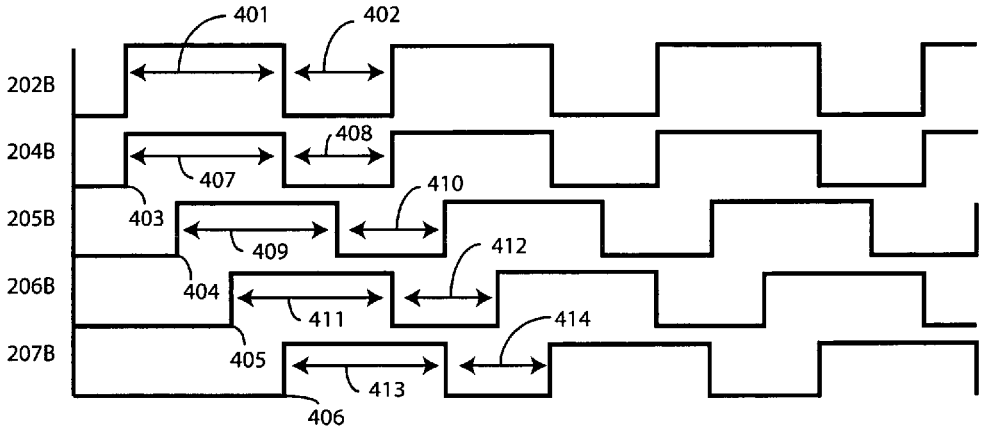

Turning now to FIG. 4, illustrated therein is an alternate control signal 202B and illumination control signals 204B, 205B,206B,207B that may be generated by an illumination controller (107) in accordance with the invention upon receipt of control signal 202B. While the illumination control signals of FIG. 3 (204A,205A,206A,207A) were distributed such that only one light source was active at a time, the illumination control signals of FIG. 4 204B,205B,206B,207B are staggered such that each illumination control signal overlaps another. Such may be the case where overlapping illumination is required to achieve the necessary luminous intensity. While the instantaneous current drawn from the power source (219) is higher than that associated with the waveforms of FIG. 3, it is still lower than prior art solutions where each light source is turned on simultaneously.

The control signal 202B includes an active portion 401 and an inactive portion 402. In the exemplary embodiment of FIG. 4, both the active portion 407 and the inactive portion 408 of the first illumination control signal 204B is the same as that of the control signal 202B. The actuation times 403,404,405, 406 if the illumination control signals 204B,205B,206B, 207B are distributed proportionally across the active time 401 of the control signal 202B. However, in so doing, some of the illumination control signals 204B,205B,206B,207B overlap. For example, at one point, a light source driven by control signal 204B is on at the same time as are light sources driven by control signals 205B and 206B. Note that as the duty cycle 401/402 of the control signal 202B is indicative of the light source actuation information, the duty cycles 407/408,409/410,411/412,413/414 of the illumination control signals 204B,205B,206B,207B are substantially the same as that of the control signal 202B. In practice, where minimizing current drain is important, the amount of overlap is kept to a minimum.

Figure 5:
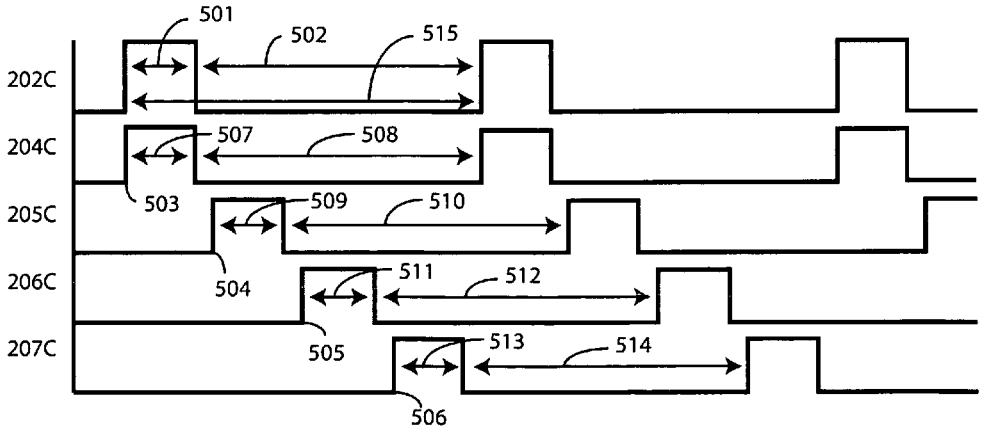

Turning now to FIG. 5, illustrated therein is an alternate control signal 202C and illumination control signals 204C, 205C,206C,207C that may be generated by an illumination controller (107) in accordance with the invention upon receipt of control signal 202C. While the illumination control signals of FIG. 3 (204A,205A,206A,207A) were distributed such that only one light source was active at a time, and the illumination control signals of FIG. 4 (204B,205B,206B,207B) were staggered such that each illumination control signal overlapped, the control signals of FIG. 5 are spread evenly across the period 515 of control signal 202C without overlapping. As the duty cycle 501/502 of control signal 202C is indicative of the amount of time that each light source is to be active, the duty cycles 507/508,509/510,511/512,513/514 of the illumination control signals 204C,205C,206C,207C are substantially the same as that of the control signal 202C. The actuation times 503,504,505,506 are staggered such that each illumination control signal 204C,205C,206C,207C does not overlap.

Figure 6:
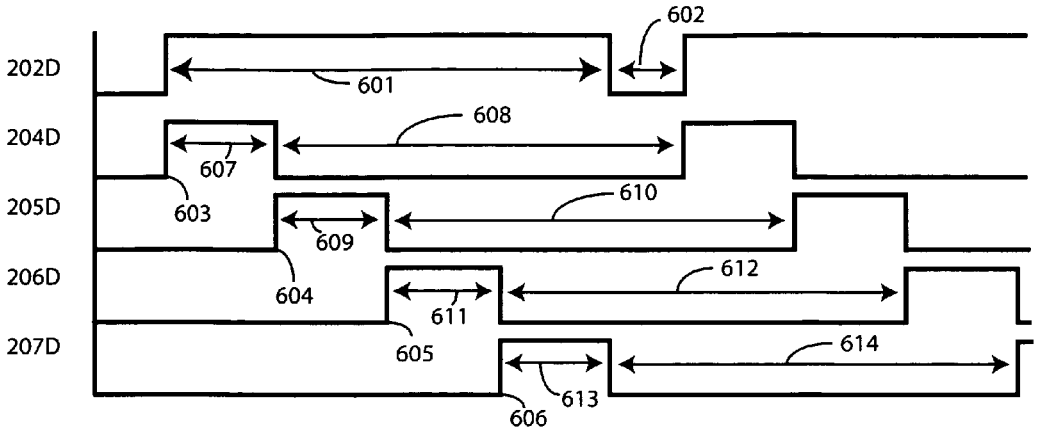
FIGS. 6,7,8 illustrate timing diagrams where an active portion of an illumination control signal and an active portion of a control signal are substantially the same in accordance with the invention.
Figure 7:
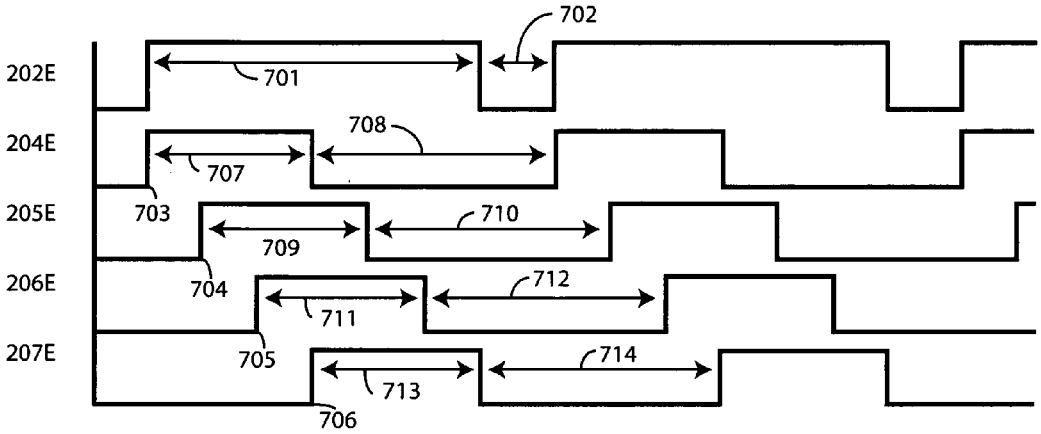
Figure 8:
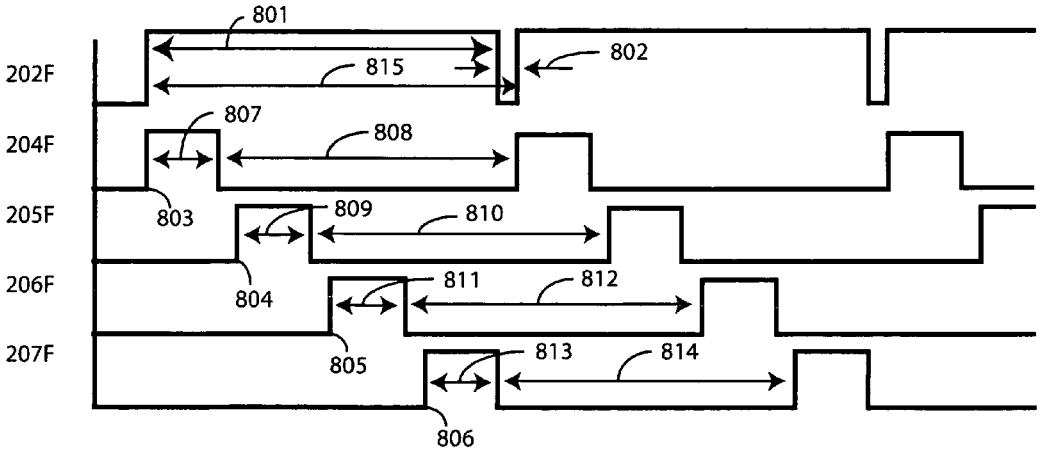

Turning now to FIGS. 6-8, illustrated therein are control signals where the illumination control signal duty cycle is characterized by an active illumination control signal time associated with an average light source luminous intensity. While in FIGS. 3-5 the illumination control duty cycle was substantially the same as that of the control signal, in FIGS. 6-8 the illumination control duty cycle is less than the predetermined duty cycle of the control signal.

Electronic devices may be made in accordance with the invention in a variety of ways. In one embodiment, the illumination controller (107) receives a control signal (202) having a duty cycle that exactly indicates the amount of time that each light source should be active. In such an embodiment, intelligence is designed in to the component generating the control signal (202). For instance, a microprocessor (106) executing firmware commands stored within memory may know what type of light source is disposed within the device, and how long each light source should be activated to achieve a predetermined luminous intensity from the plurality of light sources (102,103,104,105). As such, the control signal generator (201) may generate a control signal with that duty cycle, as was illustrated in FIGS. 3-5.

In another embodiment, intelligence may be designed into the illumination controller (107). In such a case, the control signal generator (201) may generate a pulse-width modulated signal where the active portion represents, for example, the total amount of time that the light sources should be on. In such an embodiment, the illumination controller (107) may subdivide or otherwise generate illumination control signals (204,205,206,207) so as to achieve the desired average luminous intensity. By way of example, the illumination controller (107) may divide the difference of the active signal time by a number of illumination control signals (204,205,206,207) to be generated so as to evenly distribute the illumination control signals (204,205,206,207) across the active portion of the control signal (202). The active portion of the illumination control signals (204,205,206,207) may be such that its duty cycle is active for at least a predetermined active period, where the active period is sufficient to establish at least a predetermined minimum luminous intensity from the plurality of light sources (102,103,104,105). Waveforms associated with this latter embodiment are illustrated in FIGS. 6-8.

Turning now to FIG. 6, illustrated therein is one exemplary control signal 202D and corresponding illumination control signals 204D,205D,206D,207D where the active portions 607,609,611,613 of the illumination control signals 204D, 205D,206D,207D are less than the active portion 601 of the control signal 202D. In FIG. 6, the duty cycles 607/608,609/610,611/612,613/614 are therefore less than the duty cycle 601/602 of the control signal 202D.

The illumination controller (107), upon receipt of the control signal 202D, has distributed the illumination control signals 204D,205D,206D,207D evenly and proportionally across the active portion 601 of the control signal 202D. By way of example, as there are four illumination control signals 204D,205D,206D,207D, the illumination controller (107) may divide the active portion 601 of the control signal 202D by the number of illumination control signals 204D,205D, 206D,207D to achieve an illumination control signal active time, e.g. 607. To minimize ripple on the power source (219), the illumination controller (107) may then stagger or distribute the actuation times 603,604,605,606 such that only one light source is active at a time.

Turning now to FIG. 7, illustrated therein is an alternate control signal 202E and illumination control signals 204E, 205E,206E,207E that may be generated by an illumination controller (107) in accordance with the invention upon receipt of control signal 202E. While the illumination control signals of FIG. 6 (204D,205D,206D,207D) were distributed such that only one light source was active at a time, the illumination control signals of FIG. 7 204E,205E,206E,207E are staggered such that each illumination control signal 204E,205E, 206E,207E overlaps another. As noted above, such may be the case where overlapping illumination is required to achieve the desired luminous intensity. While the instantaneous current drawn from the power source (219) is higher than that associated with the waveforms of FIG. 6, it is still lower than prior art solutions where each light source is turned on simultaneously.

The control signal 202E includes an active portion 701 and an inactive portion 702. In the exemplary embodiment of FIG. 7, both the active portion 707 and the inactive portion 708 of the first illumination control signal 204E is less than that of the control signal 202E. The actuation times 703,704,705,706 if the illumination control signals 204E,205E,206E,207E are distributed proportionally across the active time 701 of the control signal 202E. However, in so doing, some of the illumination control signals 204E,205E,206E,207E overlap. For example, at one point, a light source driven by control signal 204E is on at the same time as are light sources driven by control signals 205E and 206E. Note that as the duty cycle 701/702 of the control signal 202E is merely representative of the light source actuation information, the duty cycles 707/708,709/710,711/712, 713/714 of the illumination control signals 204E,205E,206E,207E are less than that of the control signal 202E.

Turning now to FIG. 8, illustrated therein is an alternate control signal 202F and illumination control signals 204F, 205F,206F,207F that may be generated by an illumination controller (107) in accordance with the invention upon receipt of control signal 202F. While the illumination control signals of FIG. 6 (204D,205D,206D,207D) were distributed such that only one light source was active at a time, and the illumination control signals of FIG. 7 (204E,205E,206E,207E) were staggered such that each illumination control signal overlapped, the control signals of FIG. 8 are spread evenly across the period 815 of control signal 202F without overlapping. As the duty cycle 801/802 of control signal 202F is indicative of the amount of time that each light source is to be active, the duty cycles 807/808,809/810,811/812,813/814 of the illumination control signals 204F,205F,206F,207F are substantially the same as that of the control signal 202F. The actuation times 803,804,805,806 are staggered such that each illumination control signal 204F,205F,206F,207F does not overlap.

Figure 9:
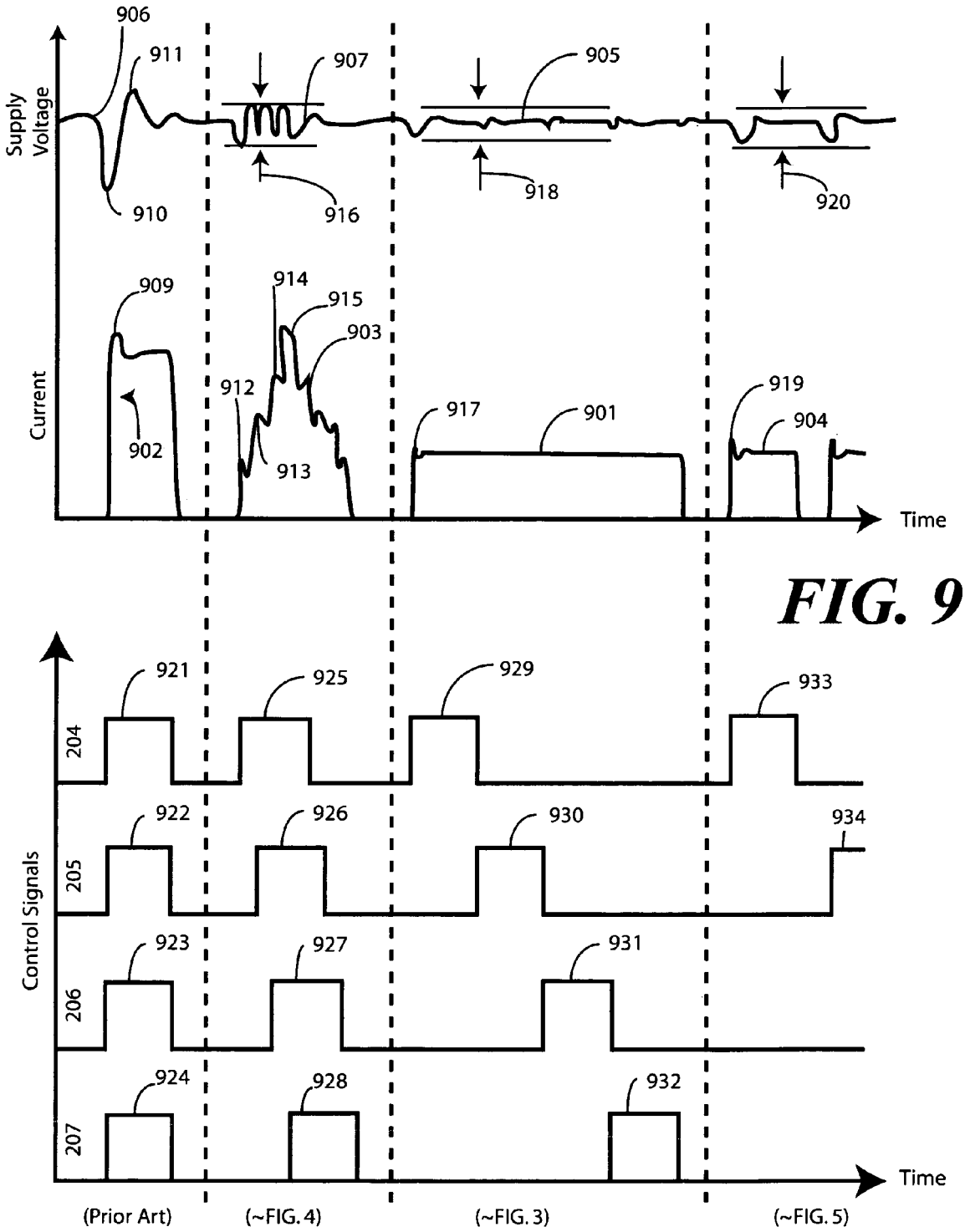
FIG. 9 illustrates exemplary current waveforms in accordance with both the invention and the prior art.

Turning now to FIG. 9, illustrated therein are various current curves 901,902,903,904 and the corresponding voltage curves 905,906,907,908 for a power source having an internal impedance. Beginning with current curve 902, this current curve is illustrative of the current curve that may be obtained with prior art devices where multiple light sources are turned on simultaneously (illustrated by illumination control signals 921,922,923,924). Using four light sources for the purposes of discussion, a large instantaneous current 909 is sourced from the power source when the four light sources actuate. This large current 909 causes the output voltage 906 of the power source to dip at point 910. As the power regulation circuitry within the power source catches up with the current demand, a spike 911 occurs in voltage. This radical change in output voltage, caused by the large instantaneous current drain 909, can cause instability and unreliability in electronic devices.

Turning now to current waveform 903, this current waveform is similar to one that may be exhibited by an actuation time distribution as shown in FIG. 4. As the light sources switch on at different times (illustrated by illumination control signals 925,296,297,928), the sudden inrush peak current 909 is not present. A first light source switches 925, causing peak 912. A second light source then switches on 926, causing peak 913. When the third light source switches on 927, peak 914 arises. As shown in the timing diagram, at one point, all four lights are on (925,926,927,928) all overlap, thereby causing peak 915. As the light sources then switch off, the current falls back to zero. By distributing the actuation times, even though the absolute current is roughly the same at peak 915 as it was during current waveform 902, the output voltage ripple 916 is less due to the fact that one light switches on at a time, rather than all four. This stair step current, combined with the inherent impedance of the power source, produces less voltage supply ripple than the prior art.

Turning to current waveform 901, this waveform is illustrative of the timing diagram associated with FIG. 3. As the actuation times (illustrated by illumination control signals 929,930,931,932) are distributed such that only one light source is on at a time, after the initial current peak 917, the current waveform 901 remains essentially constant except for minor switching noise. The net effect is less ripple 918, and thus enhanced reliability, on the voltage output 905.

Turning to current waveform 904, this waveform is illustrative of the timing diagram of FIG. 5, depicted here with illumination control signals 933 and 934. As with waveform 901, only one light source is on at a time, and thus the maximum current peak is peak 919. Due to the full ramp down prior to the next actuation time, current waveform 904 may have more ripple 920 associated therewith than does current waveform 901. The total ripple 920, however, is still considerably less than in the prior art (910,911).

Figure 10:
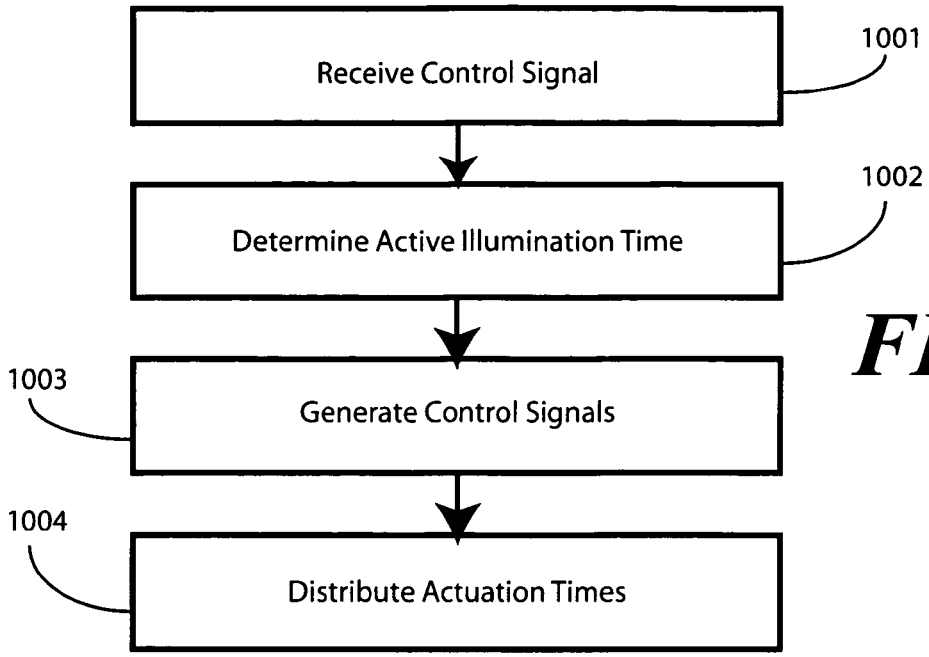
FIG. 10 illustrates a method for illuminating light sources in accordance with the invention.

Turning now to FIG. 10, illustrated therein is a method for actuating a plurality of light sources (102,103,104,105) in accordance with the invention. A control signal (202) is received at step 1001. The control signal (202) includes light source actuation information stored therein. The light source actuation information indicates at least a predetermined duty cycle (203) that is defined by a proportion of active signal time.

At step 1002, the active illumination time is determined. This may be determined my examination of the control signal (202) itself. For example, the control signal (202) may include a duty cycle indicative of an amount of time a light source is to be illuminated. Alternatively, the user or system (for instance where a light meter is embedded in the device) may override information contained in the control signal (202). A user may, for example, enter illumination information by way of the user interface (108) or keypad. A control signal generator (201) may be responsive to this user interface (108). Such information would be read and stored in step 1002. The user input may be used to alter the predetermined duty cycle (203) associated with the control signal (202).

At step 1003, a plurality of illumination control signals (204,205,206,207) is generated. Each illumination control signal (204,205,206,207) has an illumination control duty cycle associated therewith, as well as an actuation time. The illumination control duty cycle is proportional to the predetermined duty cycle (203). In one embodiment, the illumination control duty cycle is substantially the same as the predetermined duty cycle (203). In another embodiment, the illumination control duty cycle is less than the predetermined duty cycle (203). In some applications, the illumination control duty cycle may even be longer in duration than the predetermined duty cycle (203). In any of these cases, the actuation time associated with each illumination control duty cycle will be unique.

In one embodiment, the illumination control signals (204, 205,206,207) comprise pulse-width modulated signals. These pulse-width modulated signals may be employed to control at least one of a plurality of light sources (102,103, 104,105). When the illumination control signal and corresponding duty cycle is active, one of the plurality of light sources (102,103,104,105) would be illuminated.

At step 1004, the actuation times for each of the illumination control signals are distributed. They may be distributed evenly across either the period or active portion of the control signal. Alternatively, should the system or user override this information, they may be distributed in accordance with a feedback loop to achieve the desired luminous intensity.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. For example, while light sources (102,103,104,105) have been previously described as being used to backlight a display, other alternate embodiments will be obvious to those of ordinary skill in the art having the benefit of this disclosure.

Figure 11:
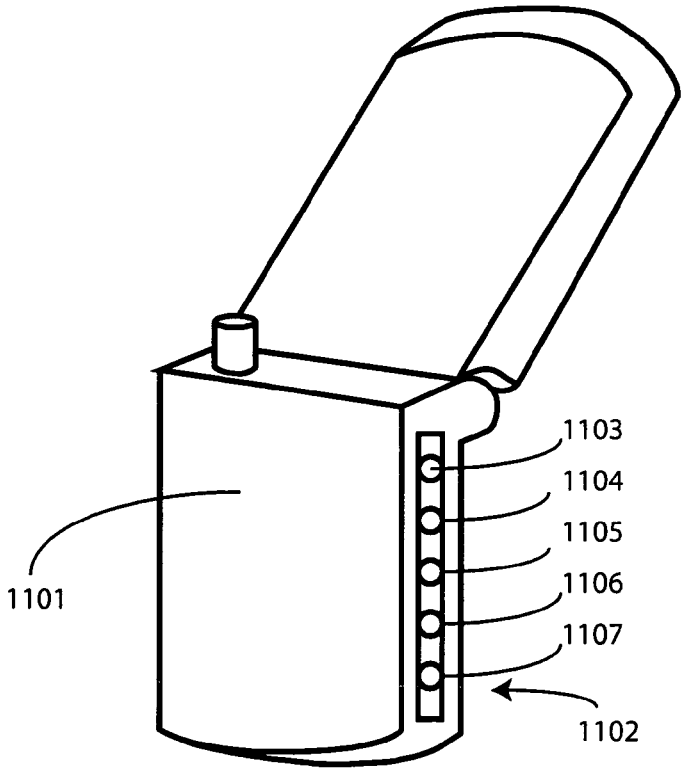
FIG. 11 illustrates a visible annunciator in accordance with the invention.

Turning briefly to FIG. 11, illustrated therein is an electronic device 1101 having a visible annunciator 1102 coupled thereto. The annunciator 1102 may be an external alarm that actuates when incoming messages or calls are received. Light sources 1103,1104,1105,1106 may indicate an alarm when any of the light sources 1103,1104,1105,1106 is active. Accordingly, the specification and figures are to be regarded in an illustrative rather than a restrictive sense, and all such modifications are intended to be included within the scope of present invention.

What is claimed is:

1. A wireless communication device, comprising:

a. an illuminated display, the illuminated display being illuminated by a plurality of light sources;

b. a control signal generator, wherein the control signal generator is capable of generating a control signal having light source actuation information associated therewith, the light source actuation information indicating at least a predetermined duty cycle defined by a proportion of active signal time; and c. an illumination controller coupled between the control signal generator and the plurality of light sources, wherein the illumination controller, upon receipt of the control signal, generates a plurality of illumination control signals, each illumination control signal having an illumination control duty cycle and an actuation time, wherein each actuation time is unique such that each of the plurality of light sources become operable at different times.

2. The wireless communication device of claim 1, wherein the proportion of active signal time corresponds to a periodic amount of time for which the plurality of light sources are to be illuminated to achieve a predetermined average luminous intensity, wherein the illumination control duty cycle is substantially equal to the predetermined duty cycle.

3. The wireless communication device of claim 1, wherein each illumination control duty cycle is characterized by an active illumination control signal time associated with an average light source luminous intensity, wherein the illumination control duty cycle is less than the predetermined duty cycle.

4. The wireless communication device of claim 1, wherein the control signal comprises a pulse width modulated signal having a predetermined period, wherein the light source actuation information comprises at least a period of time during which each individual light source is active, wherein the period of time during which each individual light source is active is distributed proportionally across the predetermined period.

5. The wireless communication device of claim 1, wherein the control signal comprises a pulse width modulated signal, further wherein each actuation time corresponds to an individual illumination time for each of the plurality of light sources, wherein the individual illumination time is distributed selected by the illumination controller so as to reduce an instantaneous current drawn by the plurality of light sources.

6. The wireless communication device of claim 1, wherein the wireless communication device comprises a mobile telephone, further wherein the illuminated display comprises a backlit, user readable display illuminated by the plurality of light sources, wherein the plurality of light sources comprise a plurality of light emitting diodes, further comprising a plurality of current sources, wherein each of the plurality of current sources is coupled serially between each of the plurality of light emitting diodes and each of the illumination control signals, such that each current source is actuated when a corresponding illumination duty cycle is active.

7. The wireless communication device of claim 6, further comprising a regulator coupled to the plurality of light sources, wherein when each current source is actuated, each of the plurality of light sources conducts current from the regulator.

8. The wireless communication device of claim 6, further comprising a user interface, wherein the control signal generator is responsive to the user interface such that the predetermined duty cycle is capable of being altered based upon information received from the user interface.

9. The wireless communication device of claim 1, wherein the illuminated display comprises a visible annunciator, wherein an alarm is indicated when any of the plurality of light sources is active.

10. The wireless communication device of claim 1, further comprising a power source coupled to the plurality of light sources, wherein each actuation time is configured such that only one of the plurality of light sources is active at a time.

11. A method for actuating a plurality of light sources, the method comprising the steps of:

a. providing an illuminated display, the illuminated display being illuminated by a plurality of light sources;

b. receiving a control signal having light source actuation information stored therein, the light source actuation information indicating at least a predetermined duty cycle defined by a proportion of active signal time; and c. upon receipt of the control signal, generating a plurality of illumination control signals to drive the plurality of light sources, each illumination control signal having an illumination control duty cycle and an actuation time, wherein the illumination control duty cycle is proportional to the predetermined duty cycle, further wherein each actuation time is unique.

12. The method of claim 11, wherein the illumination control duty cycle is such that the illumination control duty cycle is active for at least a predetermined active period, the predetermined active period being sufficient to establish at least a predetermined minimum luminous intensity from a plurality of light sources controlled by the plurality of illumination control signals.

13. The method of claim 11, wherein each of the plurality of illumination control signals comprises a pulse width modulated signal capable of controlling one of a plurality of light sources, wherein the one of a plurality of light sources is illuminated while the illumination control signal is active.

14. The method of claim 11, wherein the illumination control duty cycle is substantially equal to the predetermined duty cycle.

15. The method of claim 11, wherein the illumination control duty cycle is less than the predetermined duty cycle.

16. The method of claim 11, wherein the illumination control duty cycle greater than the predetermined duty cycle.

17. The method of claim 16, further comprising the step of adjusting the predetermined duty cycle based upon one of a user input and a system input.

18. The method of claim 11, further comprising the step of distributing the actuation times, wherein the step of distributing comprises dividing a difference of the active signal time and the actuation time by a number of individual illumination control signals.

19. A module for facilitating actuation of a plurality of light sources in response to information received from a control signal, the module comprising:

a. an input for receiving the control signal;

b. a plurality of outputs, each of the plurality of outputs being capable of generating one of a plurality of illumination control signals, each illumination control signal being capable of actuating at least one of a plurality of light sources; and c. a distributor, wherein the distributor staggers each actuation transition from an inactive portion of an illumination control signal to an active portion of the illumination control signal such that each actuation transition occurs at a different time within an active period of the control signal; and d. an illuminated display, responsive to the distributor, illuminated by the plurality of light sources in response to the illumination control signals.

20. The module of claim 19, wherein the distributor evenly distributes each actuation transition across the active period of the control signal.

* * * * *